United States Patent [19]

Hess et al.

[11] 3,934,324

[45] Jan. 27, 1976

[54] METHOD AND APPARATUS FOR FORMING AUTOMOTIVE WHEEL RIM BLANKS

[75] Inventors: Johann T. Hess, Deerfield; Kurt Debrunner; Aujit Tan, both of Chicago, all of Ill.

[73] Assignee: Grotnes Machine Works, Inc., Chicago, Ill.

[22] Filed: Feb. 14, 1975

[21] Appl. No.: 549,984

[52] U.S. Cl. ..... 29/159.1; 228/17.5; 228/125; 228/151; 228/158; 228/160; 228/166; 228/173

[51] Int. Cl.[2] ..... B21H 1/10; B21K 1/38

[58] Field of Search ..... 228/125, 144, 149, 150, 228/151, 164, 159, 160, 173, 158, 166, 13, 15.1, 17, 17.5, 48; 29/159.1; 113/1 M, 116 D, 116 W

[56] References Cited

UNITED STATES PATENTS

| | | | |
|---|---|---|---|
| 3,091,202 | 5/1963 | Mackey | 29/159.1 X |
| 3,616,985 | 11/1971 | Koch | 29/159.1 X |
| 3,862,563 | 1/1975 | Fencl et al. | 29/159.1 X |

*Primary Examiner*—Victor A. DiPalma
*Attorney, Agent, or Firm*—Wolfe, Hubbard, Leydig, Voit & Osann, Ltd.

[57] ABSTRACT

A system for forming wheel rim blanks in which a coiling station, an end conditioning press, a welding station, and a weld seam finishing station are all arranged to form a continuous path in the direction of the axis of the rim blank so that blanks can be readily transferred from one station to the next, with each station being simultaneously loaded and unloaded. In the coiling station a blank of strip material is coiled into the form of a cylinder with the longitudinal edges of the coiled blank defining a preloaded longitudinal gap. The coiled blank is then axially transferred to an end conditioning press while moving the longitudinal edges of the blank to predetermined circumferential positions so that the gap has a preselected width and circumferential location as it enters the press. Each time a coil blank is axially transferred from the coiling station to the end conditioning press, an end conditioned blank is simultaneously axially transferred from the press to the welding station. The end conditioning press flattens the longitudinal edge portions of the coiled blank, and these longitudinal edges are then welded together in the welding station. From the welding station, the welded blanks are axially transferred to a finishing station where they are advanced through a longitudinal trimming station for removing weld flash from the longitudinal surfaces of the weld seam, a planishing station for planishing the longitudinal surfaces of the weld seam, and an edge trimming station for removing weld flash from the ends of the weld seam. The system is adjustable throughout for forming rim blanks of different diameters and axial lengths.

24 Claims, 12 Drawing Figures

METHOD AND APPARATUS FOR FORMING AUTOMOTIVE WHEEL RIM BLANKS

DESCRIPTION OF THE INVENTION

The present invention relates generally to the forming of cylindrical wheel rim blanks from blanks of strip material. As used herein and in the appended claims, the term "forming" includes the coiling of the initial blank, the welding of the longitudinal edges of the coiled blank to form a closed cylinder, and subsequent clean-up or finishing of the weld seam to remove weld flash.

It is a primary object of the present invention to provide an improved system for forming wheel rim blanks at faster production rates and of better quality than was possible with systems known heretofore. In this connection, it is one specific object of the invention to provide such an improved system which is capable of producing wheel rim blanks at rates as high as 1,000 to 1,200 rim blanks per hour.

It is another object of this invention to provide an improved system for forming wheel rim blanks which facilitates the handling and transfer of the rim blanks during the successive forming operations. Thus, a related object of the invention is to provide such an improved system which permits the handling and transfer of the blanks to be completely automated, thereby significantly reducing the amount of manual labor required and also increasing the production rate.

A further object of the invention is to provide such an improved system for forming wheel rim blanks which facilitates the clean-up or finishing of the weld seams formed in the blanks.

Yet another object of the invention is to provide such an improved system for forming wheel rim blanks which is capable of forming rim blanks of a variety of different axial lengths and/or different diameters.

A still further object of the invention is to provide such an improved system for forming wheel rim blanks made from strip material and which is applicable to the forming of rim blanks for cars, trucks, mobile homes, agricultural equipment, etc.

Other objects and advantages of the invention will be apparent from the following detailed description and the accompanying drawings, in which.

Although the invention will be described in connection with a certain preferred embodiment, it will be understood that it is not intended to limit the invention to that particular embodiment. On the contrary, it is intended to cover all alternatives, modifications, and equivalents that may be included within the spirit and scope of the invention as defined by the appended claims.

Figure 1:
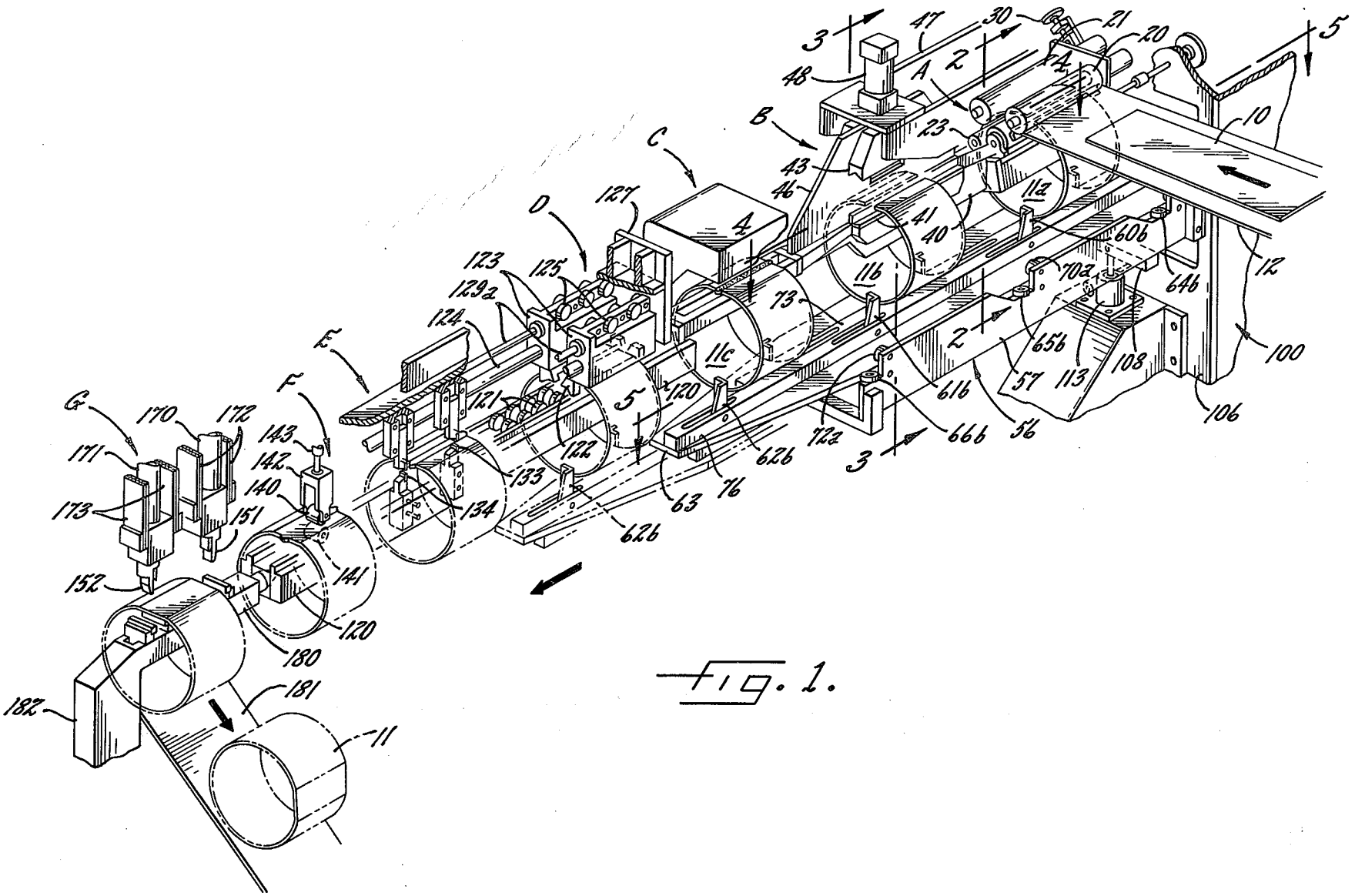
FIG. 1 is a partial perspective view of a wheel rim blank forming system embodying the invention with certain of the work stations shown in exploded positions for greater clarity.

Turning now to the drawings and referring first to FIG. 1, there is shown a completely automatic machine for converting flat metal blanks 10 into cylindrical rim blanks 11 having finished welded seams where the edges of the flat blanks are brought together to form the cylinder. The flat blanks 10 that are fed into the machine are precut to exactly the size required to form rim blanks having a preselected diameter and axial length. The flat blanks 10 are fed into the machine along a feed table 12 leading into a coiling station A where the flat blank 10 is coiled to form a cylindrical blank 11*a*.

Figure 2:
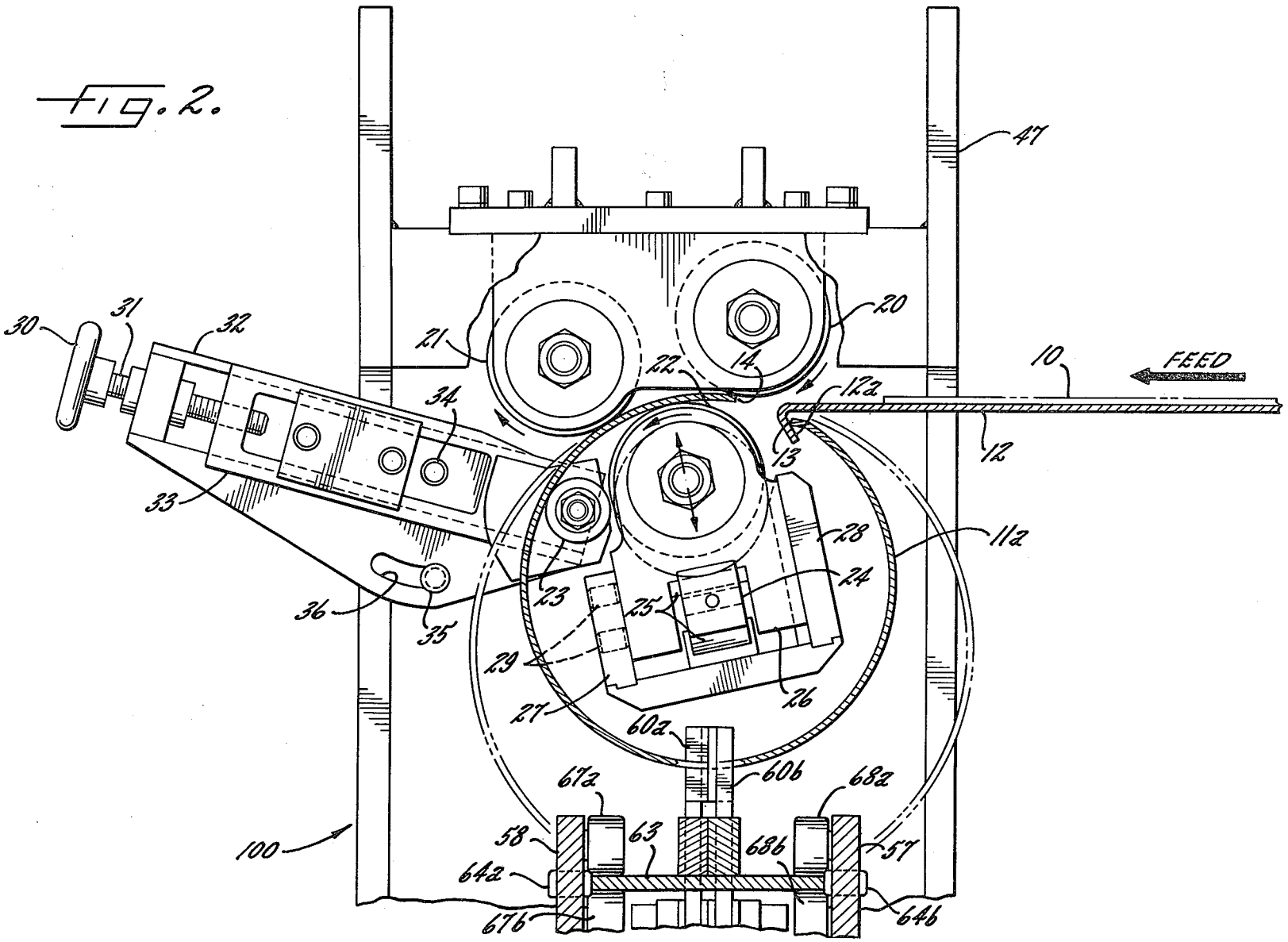
FIG. 2 is an enlarged section taken generally along line 2—2 in FIG. 1.

The coiling station A is shown in more detail in FIG. 2, where it can be seen that the flat blank 10 is coiled by a conventional pyramid type coiling arrangement comprising three primary rolls 20, 21 and 22 working on the blank. The three rolls 20–22 are all driven in the direction indicated by the arrows in FIG. 2. The two upper rolls 20 and 21 press the incoming blank 10 downwardly against the lower roll 22 with the bottom surface of the second upper roll 21 extending below the level of the feed table 12 so that it bends or coils the metal blank downwardly around the lower roll 22. This coiling action is continued until the leading edge 13 of the blank engages a depending flange 12*a* which serves as a stop on the inboard edge of the feed table 12. At this point, the trailing edge 14 of the blank lies somewhere between the upper roll 20 and the lower roll 22.

The radius of curvature of the coiled blank 11*a* formed at the coiling station is controlled by the vertical position of the lower roll 22 as well as the position of a secondary roll 23. The position of the roll 22 can be adjusted by moving a pair of wedges 24 parallel to the axis of the roll 22 in a pair of complementary tapered slots 25 formed in the end plates 26 of the frame in which the roll 22 is journaled. The end plates 26 are mounted for sliding movement in the side frame members 27 and 28 of the roll frame so that advancing movement of the wedges 24 toward each other cams the end plates 26 and the roll 22 upwardly toward the rolls 20 and 21. The closer the roll 22 is located to the rolls 20 and 21, the smaller the radius of curvature of the coiled blank 11*a*. When the wedges 24 are retracted away from each other, the end plates 26 and the roll 22 move further away from the rolls 20 and 21, thereby increasing the radius of curvature of the coiled blank 11*a*. To ensure that the roll 22 is held firmly in the position set by the wedges 24, a pair of set screws 29 are threaded through the side frame member 27 into engagement with one of the sliding edges of the end plates 26 to lock the end plates in position between the two side frame members 27 and 28.

To effect fine adjustments in the radius of curvature of the coiled blank 11*a*, the secondary roll 23 is mounted for movement in two different directions. First of all, the roll 23 can be advanced and retracted relative to the roll 22 by means of a hand wheel 30 connected to a shaft 31 which is journaled in a first frame member 32 and threaded through the end of a second frame member 33 which is mounted for sliding movement on the frame member 32. Consequently, rotation of the shaft 31 advances and retracts the roll 23 which is carried on the end of the movable frame member 33. In addition, the frame member 32 is mounted for tilting movement around a shaft 34 supported by the main frame of the machine. The range of tilting movement of the frame member around the shaft 34 is limited by a locking bolt 35 fitted through an arcuate slot 36 formed in the frame member 32, with the bolt 35 also being connected to the main frame of the machine. Thus, by movement of the two frame members 32 and 33 relative to the main frame and to each other, the secondary roll 23 can be moved up into position between the lower primary roll 22 and the desired locus of the coiling blank 11*a*.

In accordance with one aspect of the present invention, an end conditioning press is located adjacent the coiling station and forms a continuous open path in the direction of the axis of the coiled blanks formed in the coiling station to permit simultaneous loading and unloading of blanks on opposite sides of the press. Thus, as shown in FIG. 1, an end conditioning press B is located adjacent the coiling station A so that the coiled blanks 11*a* can be transferred directly from the coiling station to the press in the direction of the axis of the coiled blanks. The purpose of the end conditioning press is to make the longitudinal edge portions of the coiled blank symmetrical and bring them into precise alinement with each other to ensure the production of a good weld seam. An inherent result of the coiling operation is the production of asymmetrical longitudinal edge portions, i.e., a slight bend or kink is formed near the leading edge of the blank, and the trailing end has an increasing radius of curvature. The end conditioning press removes these irregularities and produces perfectly symmetrical longitudinal edge portions so as to facilitate the subsequent welding and finishing thereof. The particular end conditioning press to be described herein is designed to flatten the longitudinal edge portions of the coiled blank, but it will be understood that the press could be designed to form other symmetrical shapes compatible with the particular welding and finishing equipment employed.

Figure 3:
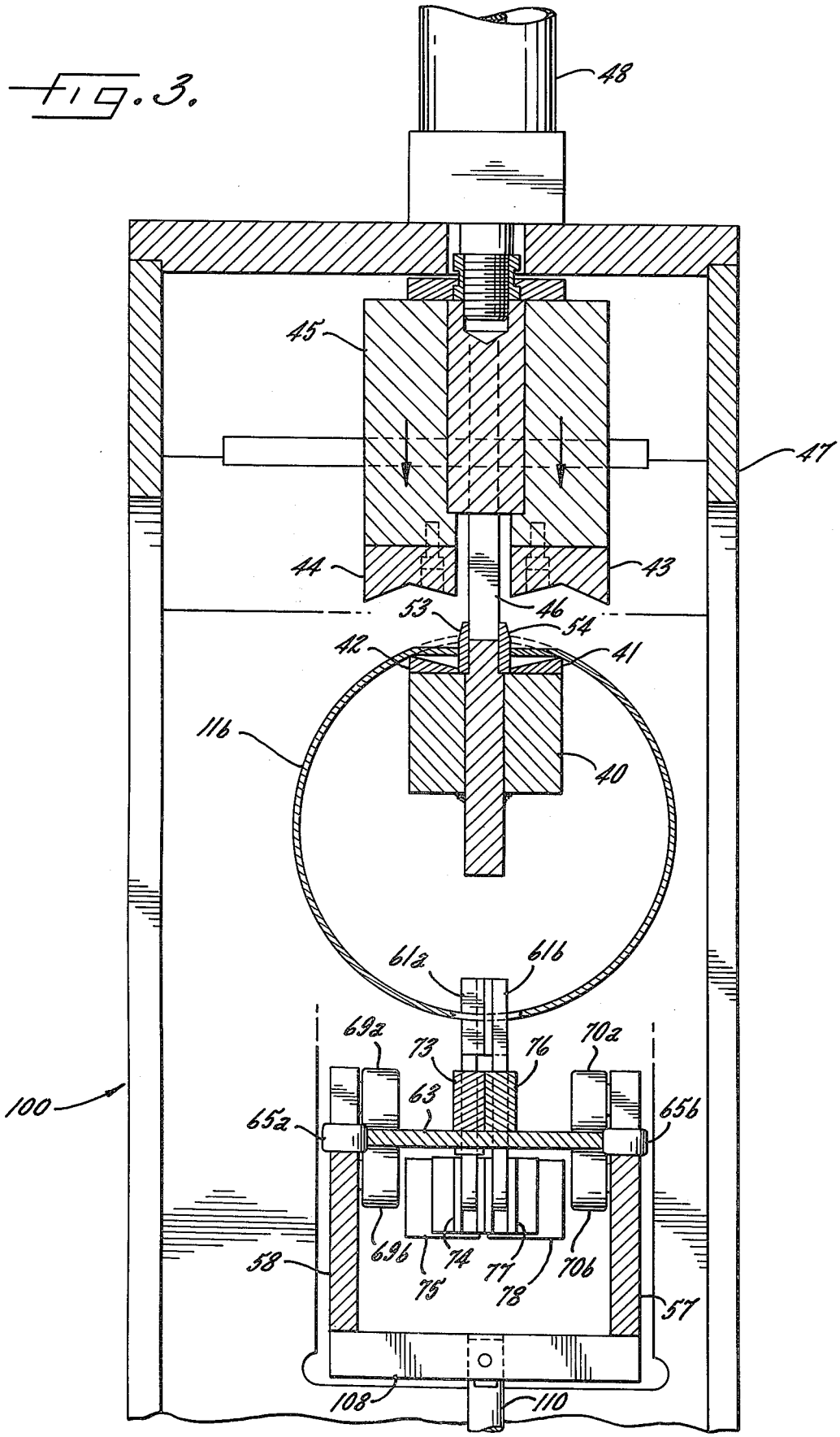
FIG. 3 is an enlarged section taken generally along line 3—3 in FIG. 1.

The details of the illustrative end conditioning press are shown more clearly in FIG. 3. The coiled blank 11*b* is supported on a horn 40 extending laterally from the coiling station, with a pair of dies 41 and 42 mounted on the top of the horn 40 at the press station B. These dies 41 and 42 cooperate with a complementary pair of dies 43 and 44 carried on the lower end of a ram 45 mounted for vertical movement on opposite sides of a horn support plate 46 which extends through the gap between the longitudinal edges of the coiled blank to support the horn 40. The top of the plate 46 is supported by an overhead cantilevered portion 47 of the main frame, which also supports a hydraulic cylinder 48 for driving the ram 45 and dies 43 and 44 downwardly against the rim blanks.

When the ram 45 is lowered, the inboard portions of the dies 43 and 44 bend the longitudinal edge portions of the coiled blank 11*b* down against the dies 41 and 42, while the outboard portions of the dies 43 and 44 bear against the body portions of the blank adjacent the edge portions which are being bent downwardly to ensure that the longitudinal edge portions of the blank are permanently deformed. Because of the inherent resilience of the metal comprising the coiled blanks, the dies 41–44 are designed to bend the longitudinal edge portions of the blanks beyond their desired final positions (shown in FIG. 3), so that when the metal springs back toward its original circular configuration upon release of the dies, the edge portions assume the desired configuration shown in FIG. 3.

In accordance with a further aspect of the present invention, the longitudinal edges of the coiled blank are positively positioned at predetermined circumferential locations during the transfer of the blank from the coiling station A to the end conditioning press B, so that the gap between the longitudinal edges of the blank has a preselected width and circumferential location when it comes to rest in the press. Thus, the longitudinal edges of the blank automatically enter the press in exact alinement with the press dies. When the coiled blank 11*a* is formed in the coiling station A, the leading edge of the blank is positively positioned by the depending flange 12*a* on the inboard edge of the feed table 12. However, the trailing edge of the coiled blank is not positioned in any positive manner, and roll friction causes the circumferential location of this trailing edge to vary somewhat from blank to blank.

Figure 4:
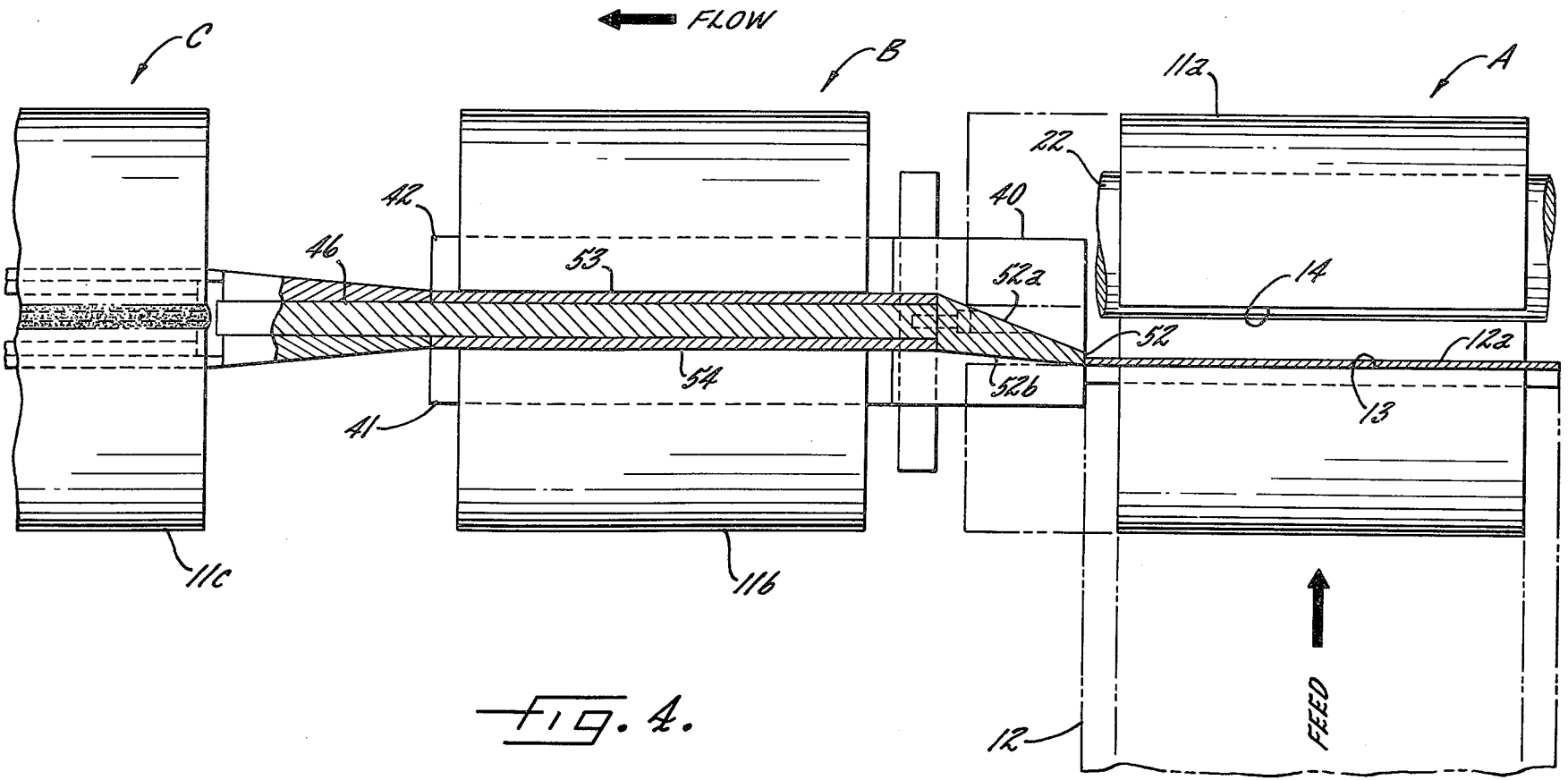
FIG. 4 is an enlarged section taken generally along line 4—4 in FIG. 1.

As shown most clearly in FIG. 4, as the coiled blank 11*a* is transferred from the coiling station A to the end conditioning press B, the trailing edge 14 of the coiled blank engages an inclined surface 52*a* formed by a transition cma 52 so that continued movement of the coiled blank in the direction of its axis results in camming of the trailing edge 14 into alinement with a gap bar 53 on one side of the horn support plate 46. It will be appreciated that the inclined surface 52*a* on the transition cam 52 extends across the entire space in which the trailing edge 14 might be located, so that no matter where the trailing edge of the blank is located at the end of the coiling operation, it will eventually come into engagement with the cam surface 52*a* and the gap bar 53.

The leading edge 55 of the coiled blank is guided by the opposite surface 52*b* of te transition cam 52. This surface 52*b* is alined at one end with the blank-engaging surface of the flange 12*a*, and at the other end with a gap bar 54 on the opposite side of the horn support plate 46 from the gap bar 53. There is a slight horizontal offset between the two ends of the cam surface 52*b* to allow the leading edge 13 of the blank to spring slightly toward the trailing edge 14 as the trailing edge is cammed away from the leading edge by the cam surface 52*a*. Thus, it can be seen that the transition cam 52 serves to seek and locate the trailing edge 14 of the coiled blank and then guide it onto of the gap bar 53, while guiding the leading edge 13 of the coiled blank onto the other gap bar 54. Consequently, the leading and trailing edges of the blank are precisely positioned at preselected circumferential locations as they enter the end conditioning press station B. The combination of the transition cam 52 and the gap bars 53 and 54 also maintain a preselected gap width, with the inherent resilience of the blank metal urging the two longitudinal edges thereof against the respective gap bar 53 and 54. As a result, the longitudinal edge portions of the blank are automatically positioned in precise alinement with the dies 41–44 of the end conditioning press.

As shown most clearly in FIG. 3, the top portions of the outboard surfaces of the gap bars 53 and 54 are tapered so that any slight displacement of the top dies 43 and 44 will not cause them to become hung up on the gap bars during downward movement of the ram 45.

After a blank has been end conditioned by the press B, the blank is again transferred in the direction of its axis to an adjacent welding station C where the longitudinal edge portions of the coiled blank are butt welded. This welding operation per se is well known in the rim forming art, and it will be understood that any of a variety of different well known welding techniques may be employed. For example, the blank edges may be welded by flash butt welding, current penetration bar butt welding, induction welding, laser beam or electron beam welding, or any other suitable welding techniques known today or to be developed in the future. As can be seen in FIG. 1, the end conditioned blanks 11*b* continue to be supported by the horn 40 as they are transferred from the end conditioning press B to the welding station C.

In keeping with the invention, the unloading of the coiled blanks from the coiling station A, the loading and unloading of blanks to and from the end conditioning press B, and the loading and unloading of the welding station C are all effected simultaneously by an automatic transfer mechanism which grips the bottom portions of the three coiled blanks simultaneously and transfers them from one station to the next. This transfer mechanism is shown in FIGS. 1–3, and in greater detail in FIGS. 5–8. Basically, the transfer mechanism comprises three sets of clamps which grip opposite ends of the coiled blanks at the coiling station A, the end conditioning press B, and the welding station C, and a shuttle which moves the three sets of jaws back and forth between the respective work stations. The transfer mechanism is also adjustable in both the longitudinal and vertical directions to accommodate blanks of different axial lengths and/or different diameters. While the work stations in the illustrative system are located directly adjacent each other, it will be understood that idle stations may be provided between adjacent work stations if desired, with additional sets of clamps being added to the transfer mechanism to handle the blanks at the idle stations.

Thus, in the illustrative embodiment, three rear clamping jaws 60*a*, 61*a* and 62*a* cooperate with three front clamping jaws 60*b*, 61*b* and 62*b* to grip the coiled blanks 11*a*, 11*b* and 11*c* at the coiling station A, the end conditioning press B, and the welding station C, respectively. These three sets of clamping jaws are all carried on a common shuttle plate 63 which is supported and guided in a frame assembly 56 which includes a pair of frame plates 57 and 58 located on opposite sides of the shuttle plate 63 and carrying three longitudinally spaced pairs of side rollers and six pairs of transversly and longitudinally spaced top and bottom rollers which guide the shuttle plate during its transversing movement. The three pairs of side rollers 64*a*, 64*b*; 65*a*, 65*b*; and 66*a*, 66*b* bear against the side edges of the shuttle plate 63 to hold it in a fixed horizontal position while permitting longitudinal movement thereof. The six pairs of cooperating top and bottom rollers 67*a*, 67*b*; 68*a*, 68*b*; 69*a*, 69*b*; 70*a*, 70*b*; 71*a*, 71*b*; and 72*a*, 72*b* ride on the upper and lower surfaces of the shuttle plate 63 to hold it in a fixed vertical position while permitting longitudinal movement thereof.

To permit retracting movement of the shuttle plate 63 without adjusting its vertical position, the three sets of clamping jaws are mounted for pivotal movement so that they can be retracted below the bottom portions of the coiled blanks 11*a*, 11*b* and 11*c* during the return movement of the shuttle. More specifically, the three rear jaws 60*a*, 61*a* and 62*a* are all pivoted in slots in a common carrier bar 73 secured to the top of the shuttle plate 63. The lower portions of the three rear jaws extend downwardly through slots in the shuttle plate 63 and are pivoted to an actuating bar 74 connected to the rod of a hydraulic cylinder 75 which is fixed to the carrier bar 73. Consequently, when the hydraulic cylinder 75 moves the actuator bar 74 relative to the carrier bar 73, the three rear jaws are simultaneously pivoted about their fixed pivot points on the carrier bar 73. When the actuator bar 74 is advanced relative to the carrier bar 73, i.e., moved to the left as viewed in FIG. 7, the three rear jaws are pivoted downwardly beneath the bottom surfaces of the coiled blanks 11 to release the blanks and to permit the transfer mechanism to clear the blanks during the return movement of the shuttle plate. When the actuator bar 74 is retracted relative to the carrier bar 73, i.e., moved to the right as viewed in FIG. 7, the rear jaws are pivoted upwardly into engagement with the rear edges of the three respective coiled blanks 11*a*, 11*b* and 11*c* located at the coiling station A, the end conditioning press B, and the welding station C, respectively.

The mounting and actuating arrangement for the three front jaws 60*b*, 61*b* and 62*b* is similar to that just described for the rear jaws, except that the front jaws are reversed to grip the forward ends of the coiled blanks. Thus, the shown most clearly in FIG. 8, the three front jaws are pivoted in slots in a common carrier bar 76 secured to the top of the shuttle plate 63, with the lower portions of the three jaws extending downwardly through slots in the shuttle plate 63 for pivotal connection to an actuator bar 77 beneath the shuttle plate 63. The actuator bar 77 is advanced and retracted relative to the carrier bar 76 by means of a hydraulic cylinder 78 fixed to the carrier bar 76. Advancing movement of the actuator bar 77, i.e., movement to the left as viewed in FIG. 8, pivots the front jaws upwardly into gripping engagement with the front edges of the respective coiled blanks 11, while retracting movement of the actuator bar 77, i.e., movement to the right as viewed in FIG. 8, pivots the front jaws downwardly to their retracted positions for return movement of the shuttle.

To permit the transfer mechanism to be used with coiled blanks of different axial lengths, the distance between each pair of jaws can be adjusted by longitudinal movement of the entire rear jaw assembly comprising the three rear jaws, the carrier bar 73, the actuator bar 74 and the cylinder 75. This longitudinal adjustment is effected by means of a hand wheel 80 which turns a shaft 81 keyed to the shuttle frame 56 and threaded through a boss 82 welded to one side of the carrier bar 73. The shaft 81 includes a split toothed coupling 83 between the shuttle plate 63 and the end plate 84 of the shuttle frame 56 to permit the shuttle plate to be moved away from its frame 56 in the longitudinal direction. A biasing spring normally urges the section of the coupling 83 connected to the shaft 81 away from the shuttle plate 63, but when the shuttle plate 63 is in its retracted or "home" position, the hand wheel 80 can be advanced against the spring bias to engage the teeth of the two sections of the coupling 83 so that the rear jaw assembly can be adjusted relative to the fixed front jaw assembly.

In order to move the shuttle plate 63 back and forth between its retracted position (shown in solid lines in FIG. 1) and its advanced position (shown in broken lines in FIG. 1), the rear end of the shuttle plate carries a block 90 secured to the rod of a hydraulic cylinder 91. Thus, advancing movement of the cylinder rod, i.e., to the left as viewed in FIGS. 5–8, advances the shuttle plate along with the three sets of clamping jaws, while retracting movement of the cylinder rod, i.e., to the right as viewed in FIGS. 5–8, retracts the shuttle assembly relative to the frame assembly 56.

Figure 5:
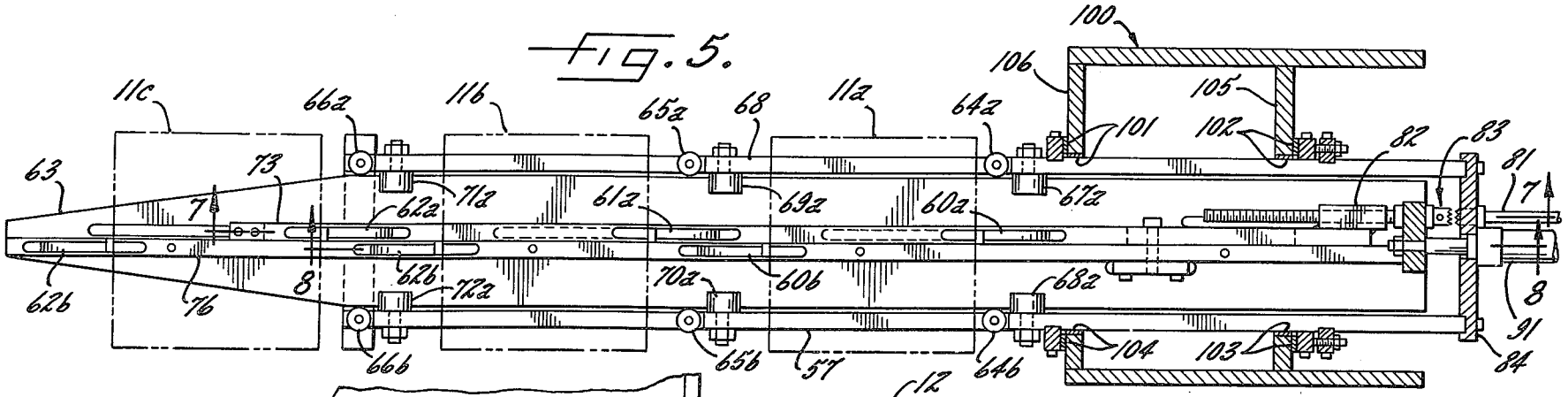
FIG. 5 is an enlarged section taken generally along line 5—5 in FIG. 1.
Figure 6:
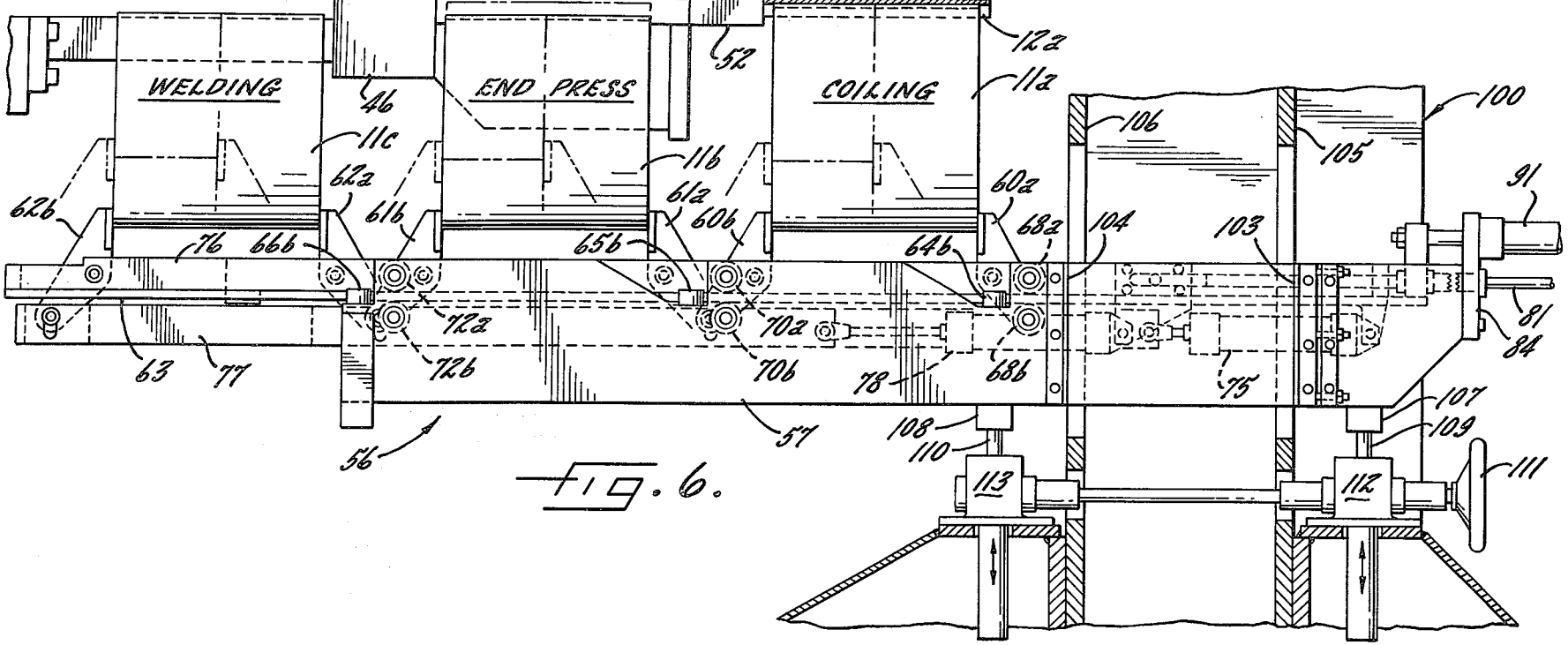
FIG. 6 is a side elevation of the structure shown in FIG. 5.
Figure 7:
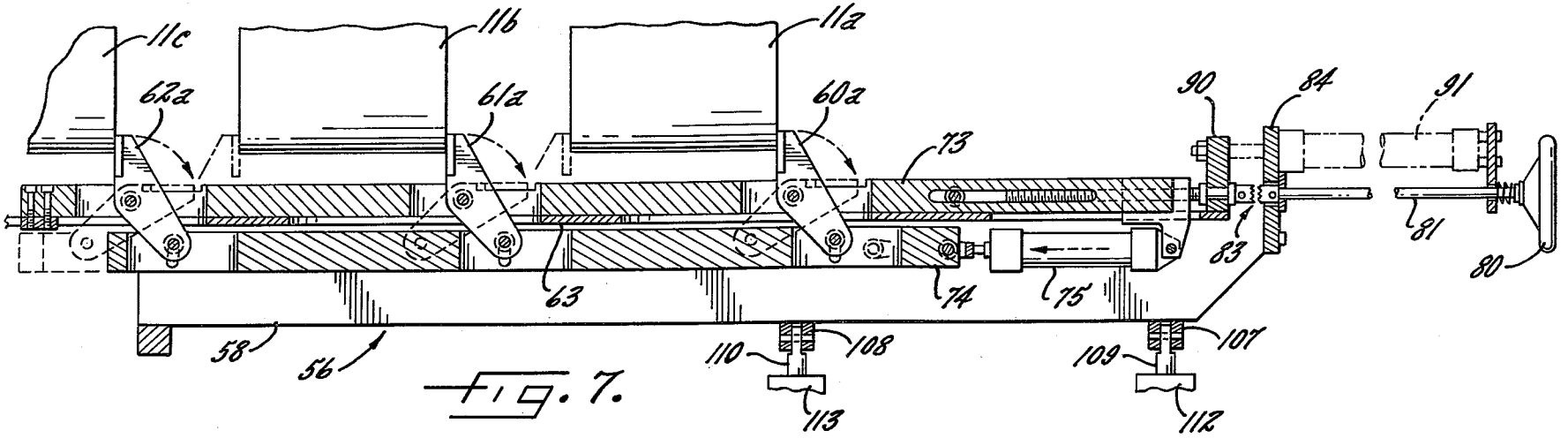
FIG. 7 is a section taken along line 7—7 in FIG. 5 with the rear clamp assembly in its raised position.
Figure 8:
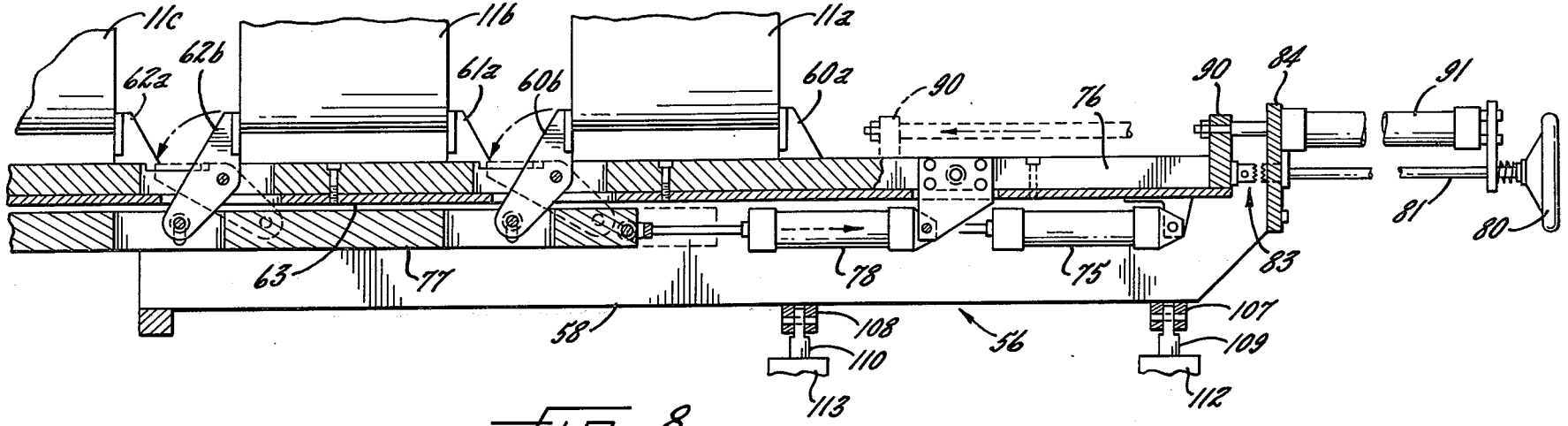
FIG. 8 is a section taken along line 8—8 in FIG. 5 with both the front and rear clamp assemblies in their raised positions.

To permit adjustment of the transfer mechanism to accommodate coiled blanks of different diameters, the entire shuttle frame assembly 56 is mounted for vertical movement within the vertical column 100 of the main frame. Thus, as shown in FIG. 5, the frame assembly 56 carries four pairs of perpendicular bearing pads 101, 102, 103 and 104 which ride on vertical tracks formed by the two main frame plates 105 and 106. The underside of the frame assembly 56 rests on a pair of pads 107 and 108 secured to the upper ends of a pair of jacks 109 and 110 which can be raised and lowered to adjust the vertical position of the frame assembly 56. More specifically, vertical movement of the two jacks 109 and 110 is controlled by a hand wheel 111 which turns a pair of worm gears in jack housings 112 and 113 to raise and lower the corresponding pads 107 and 108. The two jacks are mounted on the bed of the main frame of the machine, as shown most clearly in FIG. 1.

In accordance with another important aspect of the present invention, a weld seam finishing station adjacent the welding station forms a continuous open path in the direction of the axis of the coiled blanks, and a transfer mechanism is provided for transferring blanks from the welding station to the weld seam finishing station simultaneously with the transfer of blanks to the end conditioning press and the welding station. Thus, in the illustrative embodiment the welded blanks are transferred from the welding station C to a finishing station which includes an overhead shuttle D, a longitudinal trimming mechanism E, a planishing mechanism F, and an edge trimming mechanism G. These various subassemblies included in the finishing station are shown in exploded positions in FIG. 1, and are shown in more detail in their assembled positions in FIGS. 9 and 10. It can be seen that the forward set of clamping jaws 62*a*, 62*b* transfer the welded blank 11*c* from the welding station C to the overhead shuttle mechanism D which engages the top of the welded blank and transports it through the various tools included in the finishing station. More specifically, the forward set of jaws 62*a*, 62*b* on the shuttle plate 63 transfer the welded blank 11*c* along the primary horn 40 and onto a secondary horn 120 having a series of steel transport rolls 121 mounted along the top surface thereof.

When the welded blank 11*c* is released by the jaws 62*a*, 62*b* of the transfer mechanism, the blank is vertically alined with a split overhead shuttle plate 122*a*, 122*b* forming a central longitudinal gap 122*c* (FIG. 11) exposing the weld seam along the top of the blank. This gap permits access to the weld seam by the various tools included in the finishing station as the blank is traversed therethrough. The split shuttle plate 122*a*, 122*b* is carried on the underside of a two-part carriage 123 riding on a pair of guide shafts 124. To permit the carriage 123 and shuttle plate 122*a*, 122*b* to be biased downwardly against the blank while traversing the various tools included in the finishing station, a plurality of steel cam rolls 125 are journaled in the top of the carriage 123 and ride on the underside of the bottom plate 126 of a pivoting head assembly 127.

Figure 9:
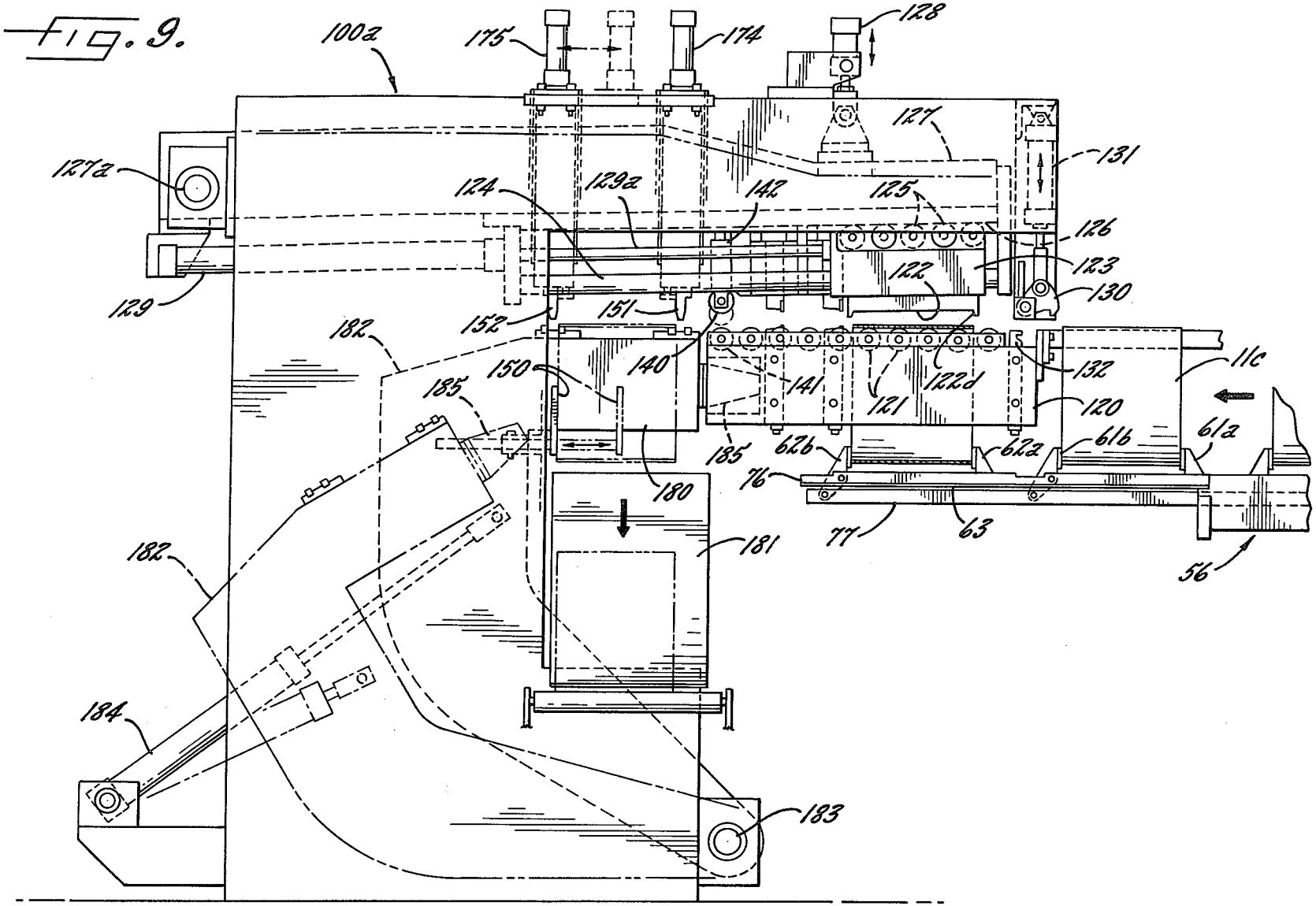
FIG. 9 is an enlarged side elevation of the finishing stations in the machine of FIG. 1, with a detachable end segment of the blank horn shown in its closed position (open position shown in phantom) and with the overhead transport and tool assembly shown in its raised position.
Figure 10:
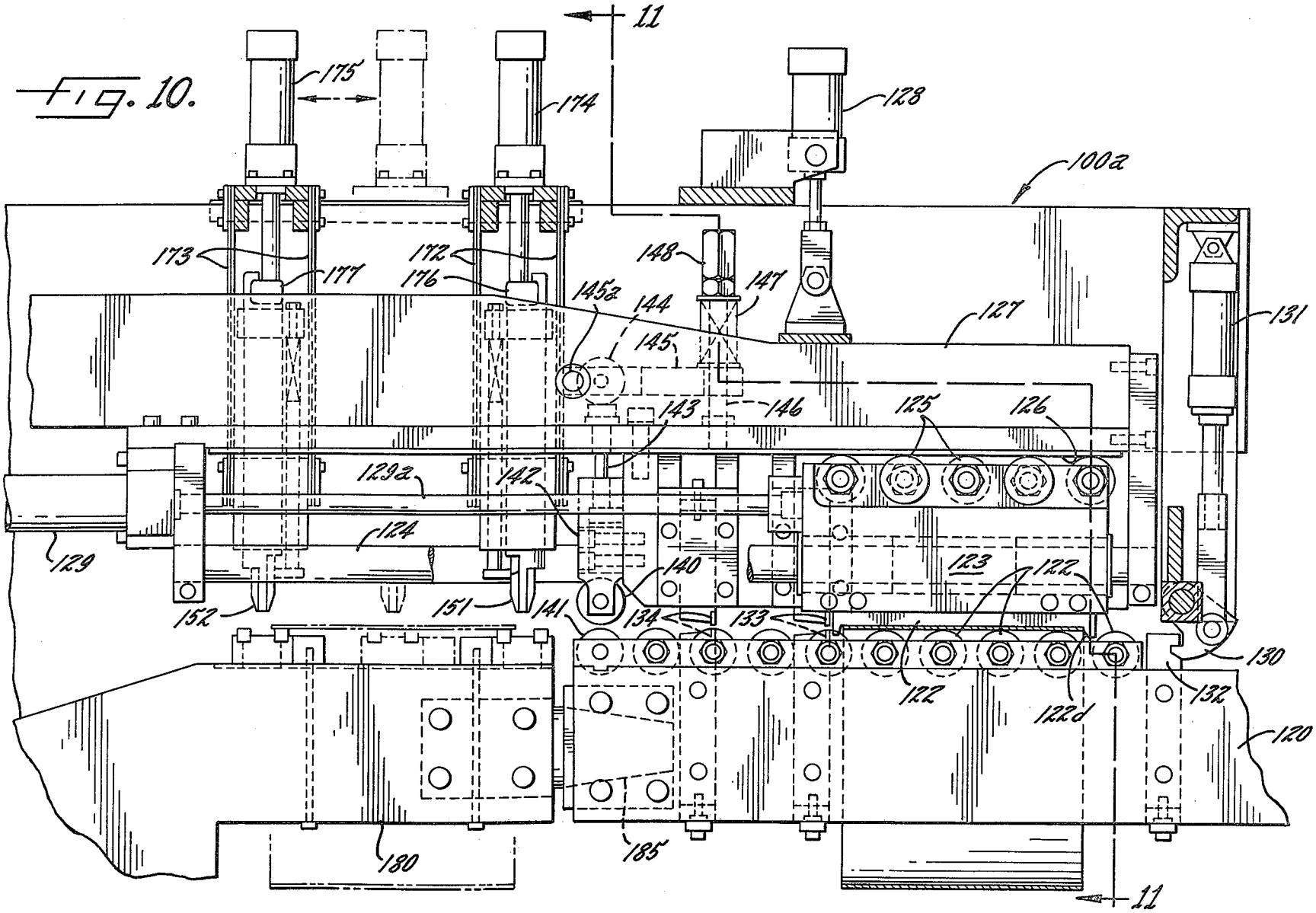
FIG. 10 is an enlarged side elevation of the finishing stations in the machine of FIG. 1 with certain portions shown in section, with the detachable end segment of the blank horn shown in its closed position, and with the overhead transport and tool assembly shown in its lowered position.

Before the bottom shuttle 62 is moved in the forward direction, the head assembly 127 is pivoted upwardly to provide an open space beneath the top shuttle 122*a*, 122*b* for receiving another welded blank 11*c*. This raised position of the head assembly 127 is illustrated in FIG. 9. When the bottom shuttle 63 begins its return movement, the head assembly 127 is pivoted downwardly to a lowered position, illustrated in FIG. 10, where the shuttle plate 122*a*, 122*b* biases the top of the blank down against the transport rolls 121. In this lowered position of the head assembly, a depending flange 122*d* on the rear edge of the shuttle plate 122*a*, 122*b* extends below the top portion of the rim blank 11*c* so that traversing movement of the shuttle plate 122*a*, 122*b* drags or pushes the blank through the various tools included in the finishing station.

Pivotal movement of the head assembly 127 is controlled by a hydraulic cylinder 128 which raises and lowers the head assembly 127 around a shaft 127*a* supported by the stationary main frame 100*a*. Within the head assembly 127, traversing movement of the shuttle plate 122*a*, 122*b* is controlled by a pair of hydraulic cylinders 129 having rods 129*a* connected to the two parts of the carriage 123. Thus, retraction of the cylinder rods 129*a* advances the carriage 123 and shuttle plate 122*a*, 122*b* through the finishing station, from right to left as viewed in FIGS. 9 and 10, with the carriage 123 riding on the shafts 124 and the cam rolls 125 rolling on the bottom plate 126. After the carriage 123 is traversed through the entire finishing station, it is returned by advancing the cylinder rods 129*a*.

To provide additional support for the secondary horn 120 that supports the rim blanks as they are traversed through the finishing station, a latch 130 is pivoted on the main frame 100*a*. Before the head assembly 127 is in its lowered position (FIG. 10), a hydraulic cylinder 131 pivots the latch 130 down into engagement with a latch bar 132 fixed to the secondary horn 120 to provide the desired additional support for that end of the horn. Before releasing the latch to permit the head assembly 127 to be pivoted upwardly to its raised position (FIG. 9), the cylinder 131 pivots the latch 130 upwardly to disengage it from the latch bar 132, thereby also clearing the path for advancement of another welded blank from the welding station.

As the shuttle plate 122 traverses the rim blank through the finishing station, the weld seam on the top of the blank is first advanced through the longitudinal trimming mechanism E where two pairs of trimming inserts 133 and 134 first remove weld flash from the longitudinal surfaces of the weld seam. The first pair of trimming inserts 133 are spaced farther apart than the second pair of inserts 134 so as to remove the outer portion, e.g., typically 80%, of the weld flash. The second pair of trimming inserts 134 then remove additional weld flash to bring the longitudinal surfaces of the weld seam relatively close to the surfaces of the parent metal on opposite sides of the seam. The lower insert of each pair is mounted on the horn 120, but the upper inserts are carried by the head assembly 127 so that the vertical positions of the upper inserts are automatically adjusted by changes in the vertical position of the head assembly 127 due to different thicknesses in the rim blanks. As shown most clearly in FIG. 11, both the upper and lower inserts are also mounted to permit manual adjustment of the vertical positions thereof to compensate for blade and chip load. More specifically, the tool holders 135 and 136 (FIG. 11) which carry the trimming inserts 133 and 134 are mounted for vertical sliding movement in the head assembly 127 and the horn 120, respectively, with the vertical positions of the tool holders 135 and 136 being controlled by manually adjustable screws 137 and 138.

Figure 11:
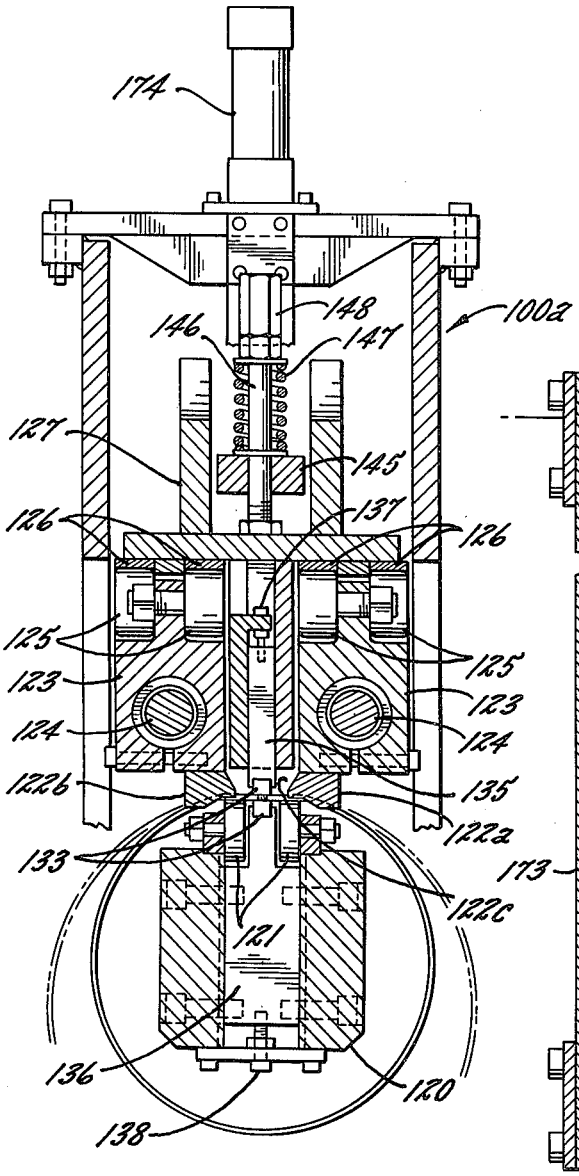
FIG. 11 is a section taken generally along line 11—11 in FIG. 10.

As the rim blank emerges from the second pair of longitudinal trimming inserts 134, the weld seam is passed between a pair of planishing rolls 140 and 141 which coin any remaining weld flash to produce a seam surface flush with the parent metal on opposite sides thereof. While the lower planishing roll 141 is journaled in a fixed position on the secondary horn 120, the upper planishing roll 140 is mounted for vertical movement and pressed against the workpiece by an adjustable spring bias. Thus, the bracket 142 in which the upper planishing roll 140 is journaled carries an upwardly extending rod 143 which is urged downwardly by a spring biased cam roll 144. More specifically, the cam roll 144 is journaled on a lever 145 which has one end pivoted to the head assembly 127 on a shaft **145*a* and the other end biased downwardly over a rod 146 by a compressed coil spring 147 (FIG. 11). The compression of the coil spring 147 can be adjusted by turning a nut 148 threaded onto the upper end of the rod 146, thereby adjusting the downward biasing force applied to the upper planishing roll 140 to press it against the weld seam passing thereunder. As in the case of the upper trimming inserts 133, 134, the upper planishing roll 140 is carried by the head assembly 127 so that it is self-adjusting in response to adjustments in the vertical position of the head assembly 127** due to different thicknesses in the rim blanks.

Figure 12:
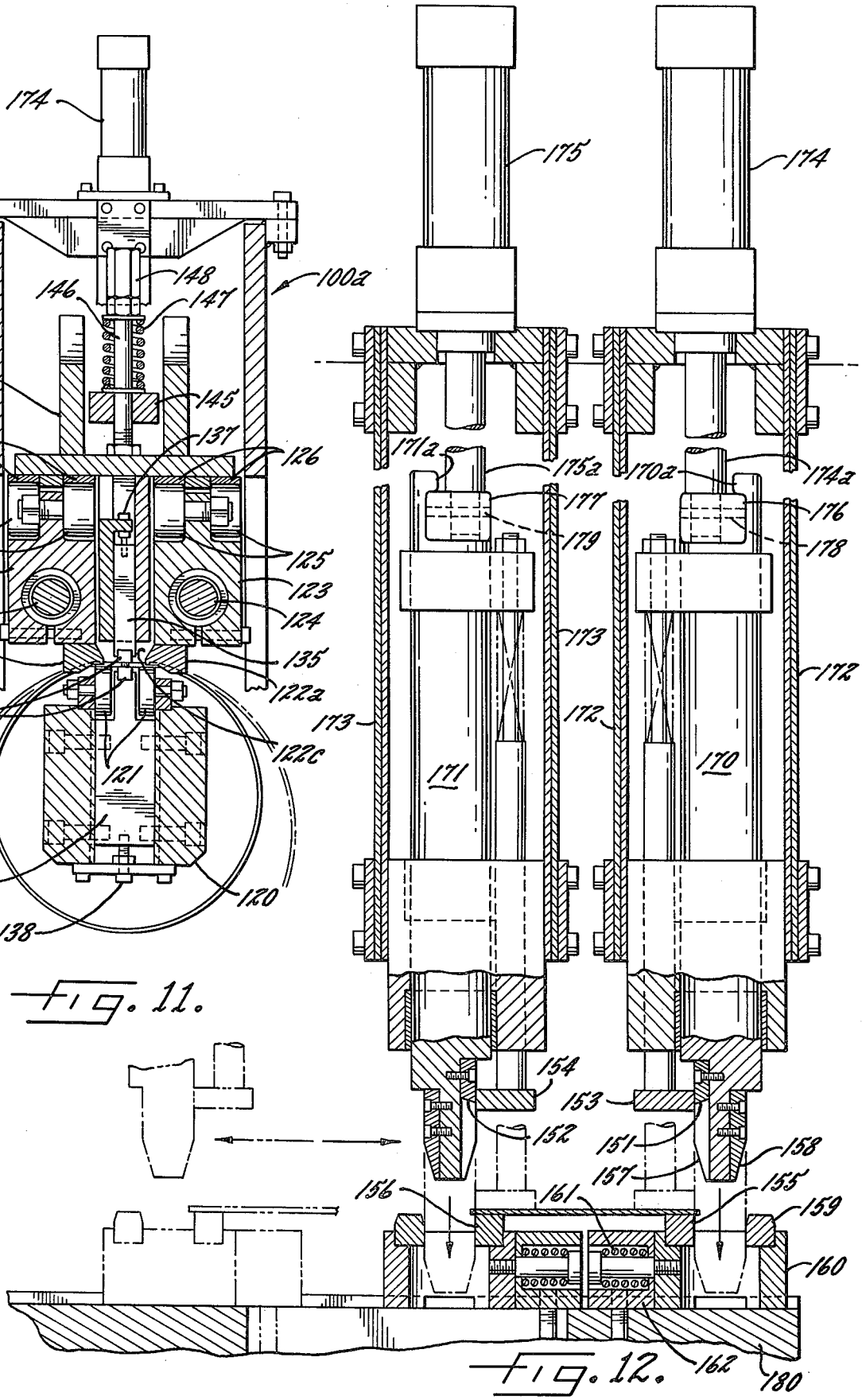
FIG. 12 is an enlarged side elevation of the edge trimming station in the machine of FIG. 1 with certain portions shown in section.

From the planishing mechanism F, the blank is advanced into alinement with the edge trimming mechanism G for trimming weld flash from the ends of the weld seam. The exact position of alinement of the rim blank with the edge trimming mechanism is determined by the end of the stroke of the cylinder rods **129*a* which drive the shuttle plate 122*a*, 122*b*. The blank is always positioned to aline the rear edge of the blank with a stationary rear edge trimming tool 151, and to aline the front edge of the blank with a manually movable front edge trimming tool 152. With the blank in this position, the edge trimming tools 151 and 152 are both driven downwardly to shear off any weld flash protruding beyond a pair of clamping pads 153 and 154 and corresponding bottom dies 155 and 156 (FIG. 12**).

If the ends of the rim blank extend beyond the clamping pads 153 and 154, a cam surface 157 depending from the rear tool 151 and/or a cam surface 158 depending from the front tool 152 engage the rim blank on opposite sides of the weld seam and move the tool or tools 151, 152 and corresponding clamping pads 153, 154 into alinement with the blank ends. This camming movement of the tool 151 and/or 152 then automatically shifts the corresponding lower die or dies 155, 156 by the same distance so that the upper and lower dies are in vertical alinement with each other by the time the tool engages the workpiece. Thus, taking the rear tool and die assembly by way of example, if the rear edge of the blank extends beyond the bottom die 155, the cam surface 157 engages the blank and displaces the tool 151 away from the die 155. This causes a second cam surface 158 to engage a block 159 mounted on a common supporting frame 160 with the die 155, thereby camming the entire lower die assembly to the right as viewed in FIG. 12, against the bias of a compressed coil spring 161 which normally holds the die frame 160 firmly against a stationary frame 162. Consequently, the die 155 is displaced to the right by the same distance that the tool 151 and clamping pad 153 were displaced so that the cooperating surfaces of the tool 151 and the die 155 are again in perfect vertical alinement with each other, and with the rear edge of the rim blank. The front die assembly operates in exactly the same manner except that the direction of movement is opposite that of the rear die assembly.

In order to maintain either or both of the downwardly moving edge trimming tool assemblies in a straight vertical position when they are moved horizontally by the camming arrangement just described, the tool holders 170 and 171 are connected to the main frame **100*a* by pairs of spring plates 172 and 173. The hydraulic cylinders 174 and 175 that control vertical movement of the tool holders 170 and 171 have their rods 174*a* and 175*a* connected to striker blocks 176 and 177 which mesh with hooked flanges 170*a* and 171*a* on the upper ends of the tool holders 170 and 171 so that the tool holders are free to move horizontally relative to the cylinder rods 174*a* and 175*a*. Horizontal pins 178 and 179 connect the rods 174*a* and 175*a* to the striker blocks 176 and 177. As a result, the weld flash is always sheared off the ends of the weld seam in a straight vertical plane, regardless of the horizontal positions of the upper tools 151, 152 and dies 153, 154**.

During the edge trimming operation the head assembly 127 is raised, and following the edge trimming operation the detachable end segment 180 of the horn 120 is retracted longitudinally away from the main body portion of the horn 120 so that the finished rim blank 11 drops onto a discharge ramp 181. A stop plate 150 (FIG. 9) on the main frame **100*a* prevents the rim blank from being carried along with the detachable horn segment 180; this plate 150 is manually adjustable for rim blanks of different axial lengths. The retracting movement of the horn segment 180 is effected by pivoting the mandrel frame 182 downwardly about a shaft 183 by means of a hydraulic cylinder 184. In FIG. 9, the detachable horn segment 180 is shown in its advanced position, with its retracted position being shown in phantom. It can be seen that the forward end of the horn segment 180 is provided with a longitudinal cone 185 which fits into a complementary recess in the main body of the secondary horn 120 to support that end of the horn body. The conical shape of the connection provides a camming action to ensure proper longitudinal registration of the segment 180 and the horn body as the segment 180** is repeatedly pivoted back and forth to discharge successive rim blanks.

One of the significant advantages of the illustrative machine is that the rim blanks are passed directly from the welding station into the finishing station, where the welded rim blank is immediately trimmed and planished. Thus, the welded seam is subjected to the trimming and planishing operations while the metal is still at a high temperature, which facilitates the finishing operation, produces a higher quality finished surface, and extends the life of the trimming inserts. These improved results are achieved without any subsequent heating steps, i.e., using only the inherent residual heat from the welding operation.

It should be noted that one of the principal advantages of the invention may be utilized by use of only one or two of the tools included in the finishing station in the illustrative system. For example, in certain applications it may be desired to trim only the longitudinal surfaces of the weld seam, without any planishing or edge trimming. In this case, the shuttle plate 122*a*, 122*b* would merely pass the rim blanks through the two pairs of trimming inserts 133, 134, but the advantage of trimming the weld seam while it is still hot, being transferred directly from the welding station to the trimmer, would still be realized, as would the self-adjusting feature of the trimmer.

As can be seen from the foregoing detailed description, this invention provides an improved system for forming wheel rim blanks at faster production rates than was possible with systems known heretofore. Indeed, the illustrative system is capable of producing wheel rim blanks at rates as high as 1,000 to 1,200 rim blanks per hour. From the time the flat blank enters the coiling station to the time the welded and finished rim blank is discharged from the edge trimming station, no manual operations whatever are required, thereby significantly reducing the amount of manual labor required in the overall rim forming process and also increasing the production rate. Because of the continuous longitudinal flow path provided by the successive work stations, the handling and transfer of the rim blanks can be completely automated without the need for any excessively complex handling and transfer devices. The use of stationary tools and a moving workpiece in the finishing station is particularly useful in facilitating a single in-line forming system. Because of the versatility of the system, it is capable of forming rim blanks of a variety of different axial lengths and/or different diameters, and it is also applicable to the forming of rim blanks for cars, trucks, mobile homes, agricultural equipment etc.

We claim as our invention:

1. A machine for forming wheel rim blanks comprising the combination of a. a coiling station for coiling blanks of strip material into the form of a cylinder with the longitudinal edges of the coiled blank defining a preloaded longitudinal gap, b. an end conditioning press adjacent the coiling station for forming symmetrical longitudinal edge portions on the coiled blank, c. a welding station adjacent the end conditioning press for butt welding the longitudinal edge portions of the coiled blank, the end conditioning press and welding station forming a continuous open path in the direction of the axis of the coiled blanks formed in the coiling station to permit simultaneous loading and unloading of blanks on opposite sides of both the end conditioning press and the welding station, and d. a transfer mechanism for simultaneously (1) transferring a coiled blank from the coiling station to the end conditioning press, (2) transferring an end conditioned blank from the end conditioning press to the welding station, and (3) transferring a welded blank away from the welding station.

2. A machine for forming wheel rim blanks as set forth in claim 1 which includes means for camming the longitudinal edges of the blanks to predetermined circumferential positions during the transfer of the blanks from the coiling station to the end conditioning press.

3. A machine for forming wheel rim blanks as set forth in claim 1 which includes means for positioning the longitudinal edges of the blanks at predetermined positions during the transfer of the blanks from the coiling station to the end conditioning press so that the gap has a preselected width and circumferential location in the press.

4. A machine for forming wheel rim blanks as set forth in claim 3 which includes means for controlling the circumferential width and location of said gap during transfer of the blanks from the end conditioning press to the welding station.

5. A machine for forming wheel rim blanks as set forth in claim 1 which includes means for internally supporting the top portions of the coiled blanks as they are transferred to and through the end conditioning press and the welding station, and a transfer mechanism disposed below the coiled blanks for gripping the bottom portions of the blanks and advancing them in the direction of their axes.

6. A machine for forming wheel rim blanks as set forth in claim 1 wherein said transfer mechanism includes at least three sets of gripping means for simultaneously gripping and advancing blanks at the coiling station, the end conditioning press, and the welding station.

7. A machine for forming wheel rim blanks as set forth in claim 1 which includes means for adjusting said transfer mechanism for gripping and advancing coiled blanks of different diameters and different axial lengths.

8. A machine for forming wheel rim blanks as set forth in claim 1 which includes e. a longitudinal trimming station adjacent the welding station for removing weld flash from the longitudinal surfaces of the weld seam, f. a planishing staton adjacent the longitudinal trimming station for planishing the longtudinal surfaces of the weld seam, g. an edge trimming station adjacent the planishing station for removing weld flash from the ends of the weld seam, the longitudinal trimming station, the planishing station, and the edge trimming station forming a continuous open path in the direction of the axis of the coiled blanks to permit simultaneous loading and unloading of blanks at opposite ends thereof, and h. shuttle means for advancing a blank sequentially through the longitudinal trimming station, the planishing station, and the edge trimming station in the interval between the transfer of successive blanks away from the welding station so that each blank can be transferred directly from the welding station to the longitudinal trimming station.

9. A machine for forming wheel rim blanks as set forth in claim 8 which includes means for continuously supporting the inside surface of the blank on opposite sides of the weld seam along the traversing path through the trimming and planishing stations, and clamping means for pressing the outside surface of the blank against the internal support on opposite sides of the weld seam while advancing the blank through the trimming and planishing stations.

10. A machine for forming wheel rim blanks comprising the combination of a. a coiling station for coiling blanks of strip material into the form of a cylinder with the longitudinal edges of the coiled blank defining a longitudinal gap, b. an end conditioning press adjacent the coiling station for forming symmetrical longitudinal edge portions on the coiled blank, c. a welding station adjacent the end conditioning press for butt welding the longitudinal edge portions of the coiled blank, d. a trimming station adjacent the welding station for removing weld flash from the weld seam, the coiling station, end conditioning press, welding station and trimming station forming a continuous open path in the direction of the axis of the coiled blanks formed in the coiling station to permit simultaneous loading and unloading of blanks on opposite sides of the end conditioning press, the welding station, and the trimming station, and e. a transfer mechanism for simultaneously (1) transferring a coiled blank from the coiling station to the end conditioning press, (2) transferring an end conditioned blank from the end conditioning press to the welding station, and transferring a welded blank from the welding station to the trimming station.

11. A machine for forming wheel rim blanks comprising the combination of a. a welding station for butt welding the longitudinal edge portions of a coiled blank of strip material, b. a trimming station adjacent the welding station for removing weld flash from the weld seam, the welding station and trimming station forming a continuous open path in the direction of the axis of the coiled blanks formed in the coiling station to permit simultaneous loading and unloading of blanks on opposite sides of the welding station and the trimming station, and c. a transfer mechanism for simultaneously loading a coiled blank into the welding station and transferring a welded blank from the welding station to the trimming station, and d. shuttle means for advancing successive rim blanks through said trimming station.

12. A machine for forming wheel rim blanks as set forth in claim 11 which includes a vertically movable head assembly carrying said shuttle means, and a fixed horn supporting the rim blanks along the inside surfaces thereof beneath said shuttle means.

13. A machine for forming wheel rim blanks comprising the combination of a. an end conditioning press for flattening the longitudinal edge portions of a coiled blank of flat strip material, b. a welding station adjacent that end conditioning press for butt welding the longitudinal edge portions of the coiled blank, the end conditioning press and welding station forming a continuous open path in the direction of the axis of the coiled blanks to permit simultaneous loading and unloading of blanks on opposite sides of both the end conditioning press and the welding station, and c. a transfer mechanism for simultaneously (1) loading a coiled blank into the end conditioning press, (2) transferring an end conditioned blank from the end conditioning press to the welding station, and (3) transferring a welded blank away from the welding station.

14. A machine for forming wheel rim blanks comprising the combination of a. a welding station for butt welding the longitudinal edge portions of a coiled blank of strip material, b. a finishing station, including a pair of trimming tools for removing weld flash from the upper and lower surfaces of the weld seam, c. shuttle means for advancing successive rim blanks through said trimming tools, d. and a vertically movable head assembly carrying said shuttle means and the upper trimming tool, said shuttle means engaging the tops of the rim blanks on opposite sides of the weld seam to fix the vertical position of the head assembly, thereby automatically fixing the vertical position of the upper trimming tool according to the thickness of the rim blanks.

15. A method of forming wheel rim blanks comprising the steps of a. loading a blank of strip material into a coiler and coiling the blank into the form of a cylinder with the longitudinal edges of the coiled blank defining a longitudinal gap, b. transferring the coiled blank to an end conditioning press while positioning the longitudinal edges of the blank at predetermined circumferential positions so that said gap has a preselected width and circumferential location as it enters said press;

c. flattening the longitudinal edge portions of the coiled blank in the end conditioning press;

d. simultaneously (1) transferring the end conditioned blank to a welding station while maintaining said gap at said predetermined circumferential location, (2) transferring another coiled blank to the end conditioning press, and (3) loading another blank of strip material into the coiler;

e. butt welding the longitudinal edge portions of the coiled blank at the welding station; and f. simultaneously (1) transferring the welded blank away from the welding station while maintaining the weld at a predetermined circumferential position, (2) transferring another end conditioned blank to the welding station, (3) transferring another coiled blank to the end conditioning press, and (4) loading another blank of strip material into the coiler.

16. A method of forming wheel rim blanks as set forth in claim 15 wherein the longitudinal edges of the coiled blank are cammed to said predetermined positions during transfer of the coiled blank from the coiler to the end conditioning press.

17. A method of forming wheel rim blanks as set forth in claim 15 wherein said end conditioning press and said welding station both form an open path in the direction of the axis of the coiled blanks to permit simultaneous loading and unloading of blanks on opposite sides of both the end conditioning press and the welding station.

18. A method of forming wheel rim blanks as set forth in claim 15 wherein the coiled blanks are transferred through said end conditioning press and said welding station in the direction of the axes of the coiled blanks.

19. A method of forming wheel rim blanks as set forth in claim 15 wherein the coiled blanks are transferred through said end conditioning press and said welding station with the axes of the blanks disposed horizontally with the gaps and weld seams being formed at the tops of the blanks, and with the blanks continuously supported beneath their top surfaces so that the bottoms of the blanks are free to be gripped by a transfer mechanism.

20. A method of forming wheel rim blanks as set forth in claim 15 which includes the steps of advancing the welded blanks continuously through a longitudinal trimming station for removing weld flash from the longitudinal surfaces of the weld seam, a planishing station for planishing the longitudinal surfaces of the weld seam, and an edge trimming station for removing weld flash from the ends of the weld seam, while continuously maintaining the weld seam at a predetermined circumferential position.

21. A method of forming wheel rim blanks as set forth in claim 15 wherein the welded blanks are advanced through the trimming and planishing stations while continuously supporting the inside surface of the blank on opposite sides of the weld seam, and continuously pressing the outside surface of the blank inwardly against the inside support on opposite sides of the weld seam so as to hold the blanks firmly in position during the trimming and planishing of the weld seam.

22. A method of forming wheel rim blanks comprising the steps of a. loading a coiled blank of flat strip material into an end conditioning press while positioning the longitudinal edges of the blank at predetermined circumferential positions so that said gap has a preselected width and circumferential location as it enters said press, b. forming symmetrical longitudinal edge portions on the coiled blank in the end conditioning press, c. simultaneously transferring the end conditioned blank to a welding station while maintaining said gap at said predetermined circumferential location and transferring another coiled blank to the end conditioning press, d. butt welding the longitudinal edge portions of the coiled blank at the welding station; and e. simultaneously (1) transferring the welded blank away from the welding station while maintaining the weld at a predetermined circumferential position, (2) transferring another end conditioned blank to the welding station, and (3) loading another coiled blank into the end conditioning press.

23. A method of forming wheel rim blanks comprising the steps of a. butt welding the longitudinal edge portions of a coiled blank of strip material at a welding station, b. transferring the welded blank in the direction of its axis from the welding station while simultaneously loading another rim blank into the welding station, c. trimming weld flash from at least the longitudinal surfaces of the weld seam at the trimming station, and d. transferring the trimmed blank in the direction of its axis away from the trimming station while simultaneously loading a new rim blank into the welding station and transferring another rim blank from the welding station to the trimming station.

24. A method of forming wheel rim blanks as set forth in claim 23 wherein weld flash is trimmed from the welded blank by advancing the blank in the direction of its axis between at least one pair of trimming tools.

* * * * *